US009163878B2

(12) United States Patent
Simon et al.

(10) Patent No.: US 9,163,878 B2
(45) Date of Patent: Oct. 20, 2015

(54) DEVICE AND A METHOD FOR TRANSPORTING BLANKS MADE FROM AN INITIALLY PLASTIC, ESPECIALLY CERAMIC, MATERIAL TO AND FROM A DRYER AND A KILN

(75) Inventors: Helmut Simon, Krumbach (DE); Franz Simmnacher, Krumbach (DE); Frank Appel, Krumbach (DE)

(73) Assignee: HANS LINGL ANLAGENBAU UND VERFAHRENSTECHNIK GMBH & CO. KG, Krumbach (DE)

( * ) Notice: Subject to any disclaimer, the term of this patent is extended or adjusted under 35 U.S.C. 154(b) by 129 days.

(21) Appl. No.: 13/500,480

(22) PCT Filed: Oct. 4, 2010

(86) PCT No.: PCT/EP2010/064758
§ 371 (c)(1),
(2), (4) Date: May 30, 2012

(87) PCT Pub. No.: WO2011/042394
PCT Pub. Date: Apr. 14, 2011

(65) Prior Publication Data

US 2012/0230802 A1 Sep. 13, 2012

(30) Foreign Application Priority Data

Oct. 5, 2009 (DE) ..... 10 2009 048 327

(51) Int. Cl.
*B28B 11/24* (2006.01)
*F27D 3/12* (2006.01)
(Continued)

(52) U.S. Cl.
CPC ..... *F27D 3/0022* (2013.01); *B28B 11/24* (2013.01); *B28B 11/248* (2013.01);
(Continued)

(58) Field of Classification Search
CPC ... F27D 3/12; F27D 2003/128; F27D 3/0021; F27D 3/0022; F26B 2210/02; B28B 11/24; B28B 11/248
USPC ..... 414/607, 173; 34/518; 425/574
See application file for complete search history.

(56) References Cited

U.S. PATENT DOCUMENTS

| | | | | |
|---|---|---|---|---|
| 1,641,186 | A * | 9/1927 | Meehan | 432/241 |
| 3,760,508 | A | 9/1973 | Hassler | |
| 4,773,850 | A * | 9/1988 | Bushman et al. | 432/5 |

FOREIGN PATENT DOCUMENTS

| | | | |
|---|---|---|---|
| DE | 21 01 073 | A1 | 2/1973 |
| DE | 33 11 828 | A1 | 9/1984 |
| DE | 10 2006 060 104 | A1 | 6/2008 |

(Continued)

OTHER PUBLICATIONS

English Machine Translation of German Patent EP 0611938 A1 Thomas Bernhardt Aug. 1994.*

(Continued)

*Primary Examiner* — Saul Rodriguez
*Assistant Examiner* — Ashley Romano
(74) *Attorney, Agent, or Firm* — Scully, Scott, Murphy & Presser, P.C.

(57) ABSTRACT

A device and method for transporting blanks is provided. The blanks are made from an initially plastic, subsequently dried and finally fired material. A transport tray transports the blanks through both a dryer and a kiln. The blanks can be stacked on a drying trolley or a firing trolley. A first transfer device transfers the blanks onto the drying trolley when the blanks are stacked on the transport tray and are plastic. The drying trolley transports the blanks and the transport tray in the dryer for drying the blanks. A second transfer device transfers the blanks and the transport tray onto the firing trolley after the blanks have been dried. The firing trolley transports the blanks and the transport tray in the kiln for firing the blanks.

14 Claims, 5 Drawing Sheets

(51) Int. Cl.

| | |
|---|---|
| ***F27D 3/00*** | (2006.01) |
| ***F26B 25/00*** | (2006.01) |
| ***F27B 9/38*** | (2006.01) |
| ***F27B 9/39*** | (2006.01) |

(52) U.S. Cl.

CPC ..... *F26B 25/001* (2013.01); *F27B 9/38* (2013.01); *F27B 9/39* (2013.01); *F27D 3/0021* (2013.01); *F26B 2210/02* (2013.01); *F27D 2003/128* (2013.01)

(56) References Cited

FOREIGN PATENT DOCUMENTS

| | | | | |
|---|---|---|---|---|
| EP | 611938 A1 * | 8/1994 | ..... | F27D 1/00 |
| EP | 1435500 A1 * | 7/2004 | | |

OTHER PUBLICATIONS

International Search Report dated Dec. 17, 2010 issued in PCT/EP2010/064758.

* cited by examiner

DEVICE AND A METHOD FOR TRANSPORTING BLANKS MADE FROM AN INITIALLY PLASTIC, ESPECIALLY CERAMIC, MATERIAL TO AND FROM A DRYER AND A KILN

BACKGROUND

The invention relates to a device and a method for transporting blanks made from an initially plastic, especially ceramic, material to and from a dryer and a kiln.

In the manufacture of blanks made from a plastic, especially ceramic, material, in particular, with blanks used in the building industry, for the manufacture of buildings, for example, for bricks or roof tiles, the blanks are transported forward in the extrusion-moist condition, having been formed through extruders or other presses, and deposited on dryer trolleys of a dryer and/or on firing trolleys of the kiln, in order to be dried and then fired, dependent upon the consistency of the material, especially the moisture, or to be fired directly. In the first case named above, a transfer of the blanks from the dryer trolley to the kiln trolley is required in every case. In the second case named above, it is necessary to unload the kiln trolleys by means of an appropriate loading device, for example, with a gripping or suction system. Accordingly, in order either first to dry and then to fire the blanks, or to fire them directly, the prior art is relatively transport- and time-intensive.

SUMMARY

The invention is based upon the object of developing further an existing device or an existing method, so that the cost for transporting the blanks is or will be reduced.

Transport trays made from a heat-resistant material for the blanks are associated with the device according to the invention, wherein the supply device for supplying the blanks to the dryer provides a blank-loading device for loading each transport tray with blanks, and the removal and supply device for removing the dried blanks provides a transfer device for gripping and transferring the respective transport tray loaded with the blanks to the kiln. As a result, it is possible to transfer the fired blanks, in each case with the transport tray carrying them, from the drying trolley to the kiln trolley, wherein the blanks themselves need not be gripped and stressed. The transport tray with the blanks can be transferred in a simple manner, because the transfer device engages with the transport tray and transfers it to the kiln trolley. According to the invention, the transport of the blanks can be reduced and facilitated, both in the previously described transfer and also in the further conveyance of the blanks at the output of the kiln, because, at the kiln output, the blanks can also be transported further with the respectively associated transport tray and unloaded from the transport tray at an appropriate station.

The supply of the extrusion-moist blanks by setting them down with the transport tray at the set-down station at the input of the dryer is also simplified and improved.

The advantages described above also apply to the method according to an aspect of the invention, wherein the blanks are loaded onto the associated transport tray, in each case by means of a blank-loading device, and, after drying, the transport tray is gripped by means of a transfer device and transferred to the kiln with the blanks disposed on it.

Since the transport trays according to the invention are made from a correspondingly heat-resistant material, they are suitable not only for the drying process but also for the firing process.

Transport trays with a plate-shaped carrying element at the top, which is preferably flat on its upper side, are suitable as transport trays. The carrying function of the transport tray is guaranteed because the transfer device provides carrying elements, preferably fork-shaped carrying arms, which engage under the transport tray, or engage in the latter. Lateral recesses in the transport tray, into which the fork-shaped carrying elements can be introduced, for example, two or three fork-shaped elements, in each case, with a horizontal distance from one another, can be used for this purpose.

The engagement of the fork-shaped carrying arms in the transport tray also achieves the advantage that the carrying arms can be arranged simply in such a manner that they do not project over the edges of the transport tray, and accordingly, several transport trays can be arranged side-by-side on a drying trolley and/or kiln trolley, so that the available space can be better exploited, and the performance of the dryer and/or of the kiln can be increased.

Further advantages of the invention can be achieved by providing a transfer device which can be moved to the removal station for the dryer and/or to the removal station for the kiln, so that one and the same transfer device can be used to grip and to transport the dried blanks and/or the fired blanks, in each case on the associated transport tray. Such an advantageous embodiment and simple design and short transport distances can then be realised, if a single transfer device can be displaced along a preferably straight movement axis, especially transversely to the longitudinal direction of the dryer and of the kiln, into stations, in which it is, on the one hand, moveable a loaded transport tray from its loading station or an intermediate station to the supply set-down station of the dryer and/or from a dryer removal station to the supply set-down station of the kiln and/or from the kiln removal station to an intermediate station or a blank removal station for the transport tray.

The arrangement and embodiment of the transfer device described above is then especially advantageously suitable in combination with a dryer and/or a kiln, which provides two longitudinal portions disposed in the manner of a turning loop, which are arranged side-by-side, so that their input and output are associated with on one and the same side.

BRIEF DESCRIPTION OF THE DRAWINGS

The invention and further advantages which can be achieved with it are explained in greater detail below on the basis of exemplary embodiments and drawings. The drawings are as follows.

DETAILED DESCRIPTION OF EXEMPLARY EMBODIMENTS

Figure 1:
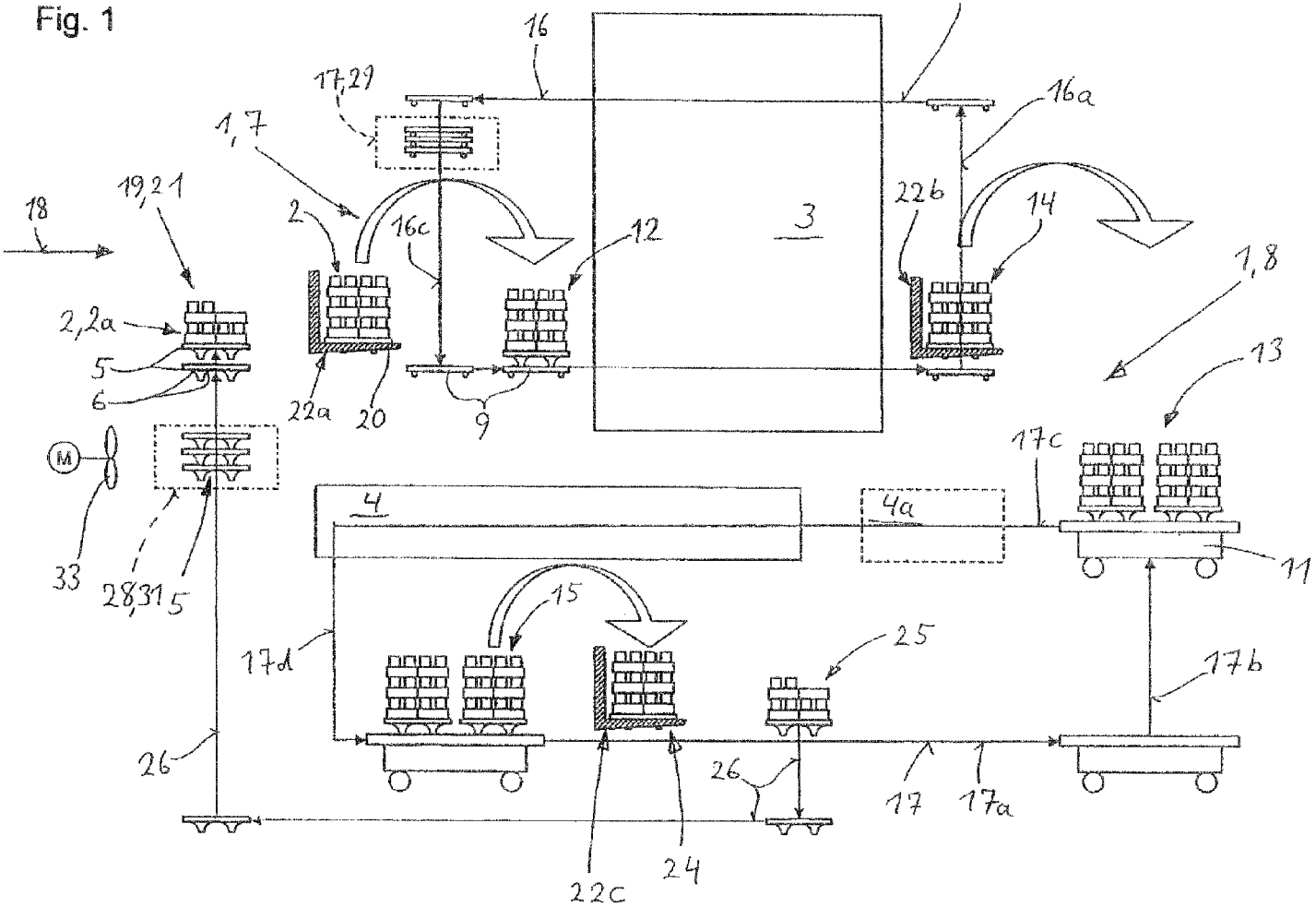
FIG. 1 shows a device according to the invention for transporting blanks made from an initially plastic, especially ceramic, material towards a dryer and from a dryer, and towards a kiln, in a schematic view.

In the exemplary embodiments to be described, the same or similar parts have been shown with identical reference numbers.

The device shown with reference number 1, is used to transport blanks 2 made from an initially plastic, especially ceramic, material towards a dryer 3 and a kiln 4. The blanks 2 are preferably disposed, in the form of a batch 2*a*, for example, a stack of blanks, on a transport tray 5, of which the horizontal longitudinal and transverse dimensions can correspond to the longitudinal and transverse dimensions of the blanks 2 or batches 2*a* disposed on it. The transport trays 5 are made from a heat-resistant material appropriate for the firing temperature and are preferably embodied identically to one another. The top carrying surface of the transport tray 5 is, in particular, rectangular, for example, square, and is preferably formed by the flat, upper side of a plate-shaped carrying element 5*a*. This can be a plate-shaped carrying element which provides laterally open recesses 6, for example, two or three in number, which are used to receive, for example, two or three carrying arms of a transport means still to be described, which can be, for example, a transport device corresponding to or similar to a forklift, with which an unloaded or loaded transport tray 5 can be displaced vertically and horizontally. The recesses 6 can be formed by feet 5*b* projecting at the bottom, which are arranged at a distance from one another and at a distance from the edge of the transport tray 5.

In one simple embodiment, the dryer 3 and/or the kiln 4 can be a drying or firing chamber, to which the loaded transport tray 5 can be supplied by a supply device 7 for a drying process and, after drying, can be removed again by a removal and supply device 8 and supplied to the firing chamber. After firing, an appropriate removal device is provided for the removal of the loaded transport tray 5.

To improve performance in the exemplary embodiment, a throughput or tunnel dryer 3 and a throughput or tunnel kiln 4 is provided, through which a corresponding plurality of dryer trolleys 9 or firing trolleys 11 can be conveyed on a transport pathway, for example, on tracks, in each case by a suitable, per se known drive device (not illustrated), and onto which or from which the loaded transport trays 5 can be placed or respectively removed at the input and output.

For functional reasons and reasons of thermal technology, it is advantageous to arrange a set-down station 12, 13 and removal station 14, 15 respectively in front of and behind the dryer 3 and the kiln 4 in the throughput direction for setting down and picking up in each case a loaded transport tray 5. A pre-heater 4*a* indicated by dotted lines, through which the firing trolleys 11 can be conveyed for preliminary heating, can be arranged between the kiln 4 and the associated set-down station 13.

For purposes of rational operation, it is also advantageous to provide a drying trolley circulation 16 and a firing trolley circulation 17, which are each formed, for example, by four circulating conveyor paths 16*a*, 16*b*, 16*c*, 16*d* and 17*a*, 17*b*, 17*c*, 17*d*, on which the dryer trolleys 9 and respectively firing trolleys 11 can be conveyed by an appropriate and per se previously known conveyor device.

The functioning of the device 1 is described below with reference to the following advantageous method steps.

The device is suitable for blanks 2 made from an initially plastic, especially ceramic, material, which is initially dried in the dryer 3 dependent upon moisture content for the purpose of preventing distortion or cracks, and then fired in the kiln 4, as is the case, especially in the manufacture of building elements, such as bricks and roof tiles.

After forming (for example through an extruder or other presses) the blanks 2 are deposited by a gripping or suction system at a loading station 21, in the extrusion-moist condition onto the respective transport tray 5. This therefore forms a batching device 19 or stacking device for building up a stack 2*a* of blanks on the transport tray 5. By means of a first transfer device 22*a*, which can be, for example, a conveyor device with projecting carrying arms 20, which can be inserted into the recesses 6, as is conventional with a forklift, the loaded transport tray 5 is conveyed to the set-down station 12 on an available drying trolley 9, and this trolley unit is then conveyed through the dryer 3. The transport tray 5 of the respectively emerging trolley unit with dried blanks 2 is then deposited by means of an identical or similar second transfer device 22*b* at the set-down station 13 disposed in front of the kiln 4 on the kiln trolley 11 available there, and this trolley unit is conveyed through the optionally available pre-heater 4*a* and the kiln 4 towards the removal station 15. Transported by means of a third transfer device 22*c* provided there, for example, another device with carrying arms 20 capable of being inserted into the recesses 6, towards an unloading station 24, at which the blanks 2 are removed from the stack by means of a stack-removal device 25 indicated schematically, and the transport tray 5 is unloaded. For a further improvement of functioning, a return device 26 for returning the unloaded transport trays 5 to the loading station 21 is provided for the device 1.

It is advantageous to provide a storage device 27, 28, respectively for the drying trolleys 9 and transport trays 5, in the region of the drying-trolley return-device 16 and the return-device 26 for the transport trays 5. As a result, it is possible to avoid throughput disturbances and to vary the rate of operation of the dryer 3 and the kiln 4, without getting into the situation of not having a drying trolley available in the region of the set-down station 12 and/or transport trays 5 in the region of the loading station 21. The respective storage device 27, 28 allows the respective arrangement of the drying trolleys 9 and transport trays 5 as a store, from which a drying trolley 9 and/or a transport tray 5 can be taken respectively.

Moreover, it is advantageous to cool the drying trolleys 9 and/or the transport trays 5 on their respective return path through an appropriate cooling device 29 or respectively 31, so that the loaded blanks do not suffer distortion or cracks as a result of excessively rapid heating. The respective cooling device 29 or 31 is particularly effective especially if it is arranged in the region of the storage device 27, 28, where several drying trolleys 9 or transport trays 5 can generally be cooled at the same time. The cooling devices 29, 31, can, for example, provide a fan 33, which generates an air stream passing over the drying trolley/s 9 and/or the transport tray/s 5.

Figure 2:
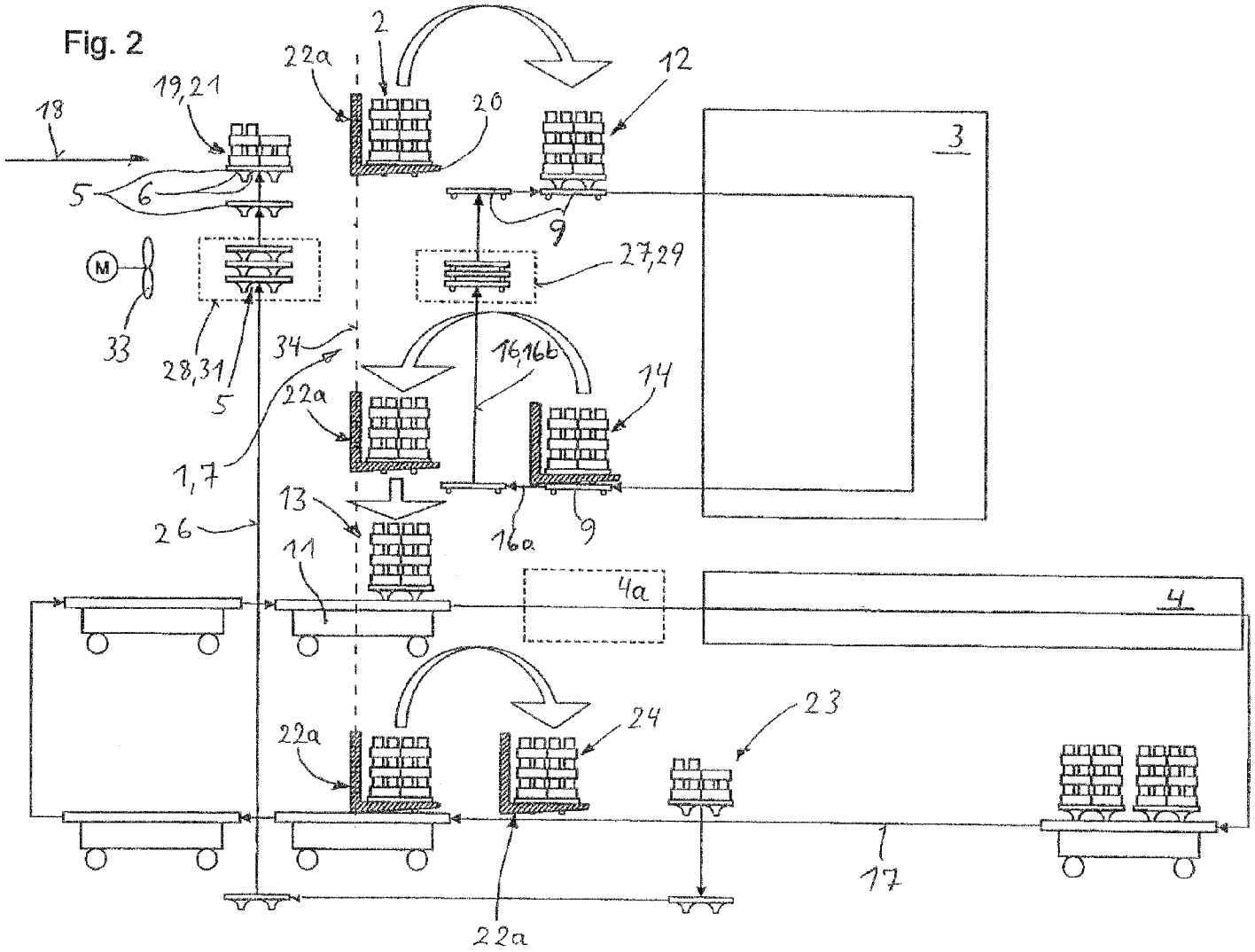
FIG. 2 shows a device according to FIG. 1 in a modified embodiment.

The exemplary embodiment according to FIG. 2 differs from the exemplary embodiment according to FIG. 1 in that a common transfer device 22*a* is provided, which can implement at least two of the transfer functions described above and, can preferably be displaced transversely to the input and/or output of the dryer 3 and/or output of the kiln 4, preferably along a straight movement line 34, in such a manner that it can be displaced for the transfer from the loading station 21 or a parallel, intermediate supply station and the supply set-down station 12 of the dryer and/or between the dryer removal station 14 and the supply set-down station 13 of the kiln 4 and/or between the kiln removal station 15 and the blank removal station 23 or an intermediate removal station 24, and can implement the transfer movements described above in its respectively associated movement station along the movement line 34.

The exemplary embodiment according to FIG. 2, in which a transfer device 22*a* can be used for at least two transfer stations, is particularly suitable for a dryer 3 or kiln 4 which provides in each case two longitudinal tunnel or throughput portions 3*a*, 3*b*, and 4*a*, 4*b*, which are arranged in the manner of a turning loop, so that they are disposed side-by-side and have their input and output at one and the same side. The ends of the longitudinal portions 3*a*, 3*b* facing away from the input and output 3*c*, 3*d* are connected to one another by a transfer platform 3*e*, by means of which the dryer trolleys 9 can be transferred from the input 3*a* to the output 3*b* in the manner of a conveyor path turning loop.

The turning-loop embodiment of the kiln 4 differs from the embodiment previously described in that the input 4*c* is in fact disposed approximately in a transverse line with the previously described inputs 3*a* and 3*b*, but the output 4*d* of the kiln 4 is disposed opposite to the input 4*c* at a longitudinal distance a, which is greater than the longitudinal dimension of the transport tray 5, so that this can be displaced inwards and outwards between the input 4*c* and the output 4*d*. With this embodiment, the kiln 4 provides three longitudinal portions 4*a*, 4*d*, 4*f*, which are connected transversely to one another by two transfer platforms 4*e* at the ends facing away from one another, through which the kiln trolleys can be transferred.

Figure 10:
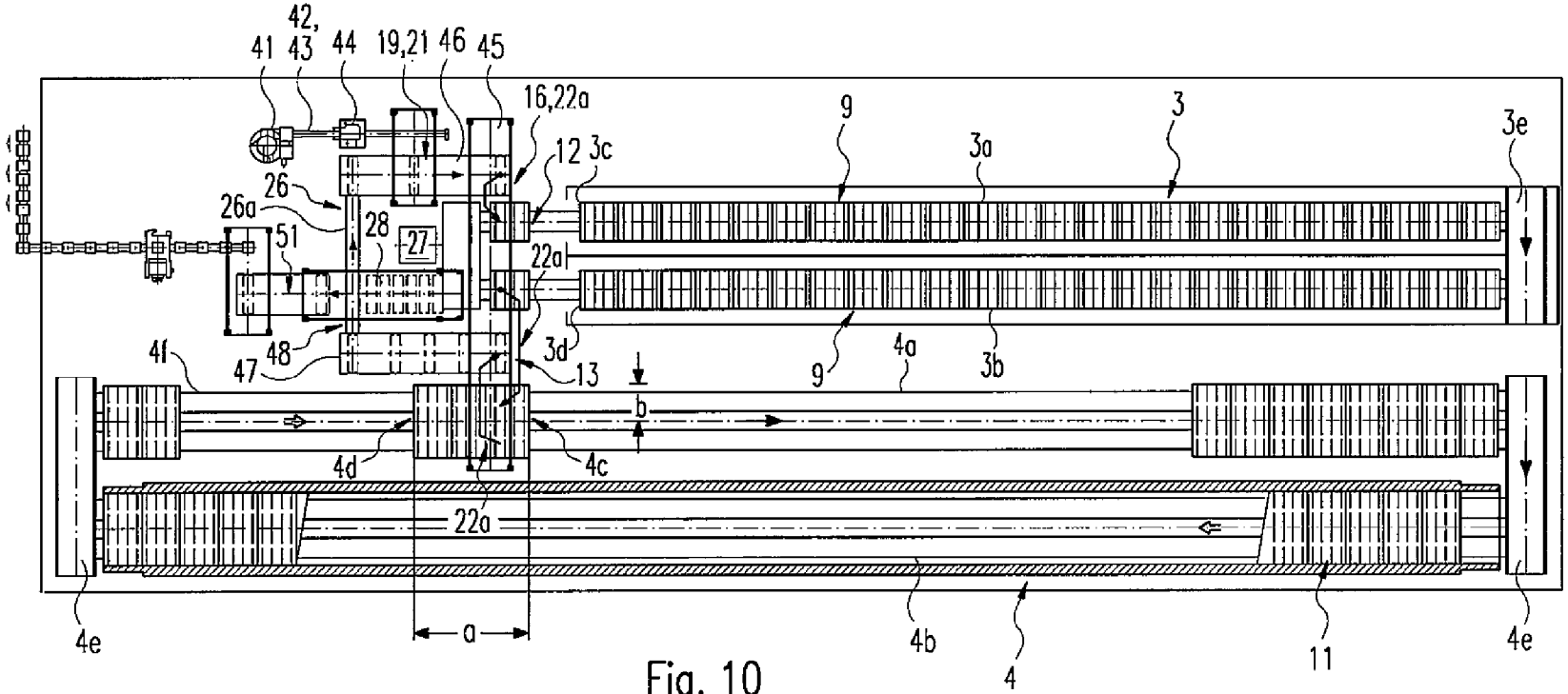
FIG. 10 shows a device for transporting blanks made from an initially plastic, especially ceramic, material to and from a dryer and a kiln, in a further modified embodiment.

Moreover, the embodiment according to FIG. 10 can correspond to the embodiment of the device 1 according to FIG. 1 or FIG. 2.

In the exemplary embodiment, an extruder 41 which, during functional operation, extrudes an extrusion-moist slab 42 onto a conveyor 43, which extends parallel to the dryer 3 or the kiln 4 and therefore longitudinally, is arranged on the side of the device 1 facing away from the kiln 4. A cutting device 44, with which the slab can be cut transversely into longitudinal portions which are not recognisable in detail, is arranged in the middle region of the slab 42.

The three transfer devices described above, or respectively a common transfer device 22*a*, can be moved transversely to and fro along a movement path 45 extending transversely to the input and output 3*a*, 3*b*, 4*a*, 4*b* and indicated schematically. Moreover, a return device 26 for the transport trays 5 is provided.

The transport trays 5 are each conveyed from a return conveyor portion 26*a* to a longitudinal conveyor 46 arranged on the side facing away from the kiln 4, which conveys the respective transport tray 5 to the right in FIG. 10 towards the loading station 21, at which the cut blanks 2 are arranged or stacked on the transport tray 5 by a batching device 19 not illustrated in greater detail. The unit comprising the transport tray 5 and the blanks 2 is conveyed by the longitudinal conveyor 46 into the transverse region of the movement path 45, from where the transfer device 22*a* displaces this unit transversely inwards and deposits it at the supply set-down station 12 of the dryer 3 on the dryer trolley disposed there. After this, the transport of the dryer trolleys 9 disposed one after the other, with the transport trays 5 and blanks 2 disposed on them, is implemented through the dryer, along the direction of the arrows.

At the output 3*b*, the transport tray 5 with the blanks 2 is displaced transversely to the supply set-down station 13 at the input 4*a* of the kiln 4 and deposited on the associated kiln trolley 11, after which, the conveying of the firing trolleys 11 and transport trays 5, with the blanks 2 arranged one behind the other, is then also implemented through the kiln 4 in a per se known manner. The horizontal size of the transport trays 5 can correspond to the horizontal size of the preferably mutually identical firing trolleys 11.

However, the horizontal size, for example, the transverse width b of the transport trays 5 can also be equal to or smaller than an associated half horizontal dimension of the associated firing trolley 11, so that two or more transport trays 5 fit onto each firing trolley 11. For example, a plurality of transport trays 5 can be arranged respectively in two rows extending along the associated longitudinal portion 4*b* of the kiln 4.

In the cases described above, the associated transfer device 22*a* operates in such a manner that it alternately conveys a loaded transport tray 5 from the kiln removal station 15 to a conveyor 47, offset, for example, towards the inside, and extending longitudinally, which supplies the blanks 2 to an unloading device 48, indicated schematically, which removes the blanks longitudinally on a longitudinal conveyor 49 in the direction of the arrow 51 and, in each case, the transport tray 5 moves, transversely to the return portion 26*a*, to the longitudinal conveyor 46 and towards the loading station 21, while the blanks 2 can be transported to a packaging region.

With this exemplary embodiment, a storage device 27 for the dryer trolley 9 and a storage device 28 for the transport trays 5 is also provided in order to guarantee a disturbance-free operation of the device 1. The storage device 27 can be arranged, for example, adjacent to the supply set-down station 12 of the dryer, for example, adjacent on the left. The storage device 28 for the transport trays 5 can be arranged, for example, disposed opposite to the output of the dryer portion 3*b*, wherein appropriate conveyors are provided to convey the dryer trolleys 9 and the transport trays 5 optionally into and out of the associated storage device 27, 28. In the exemplary embodiment, the transfer device/s 22*a* is/are illustrated by trapeze-shaped arrow portions.

Figure 4:
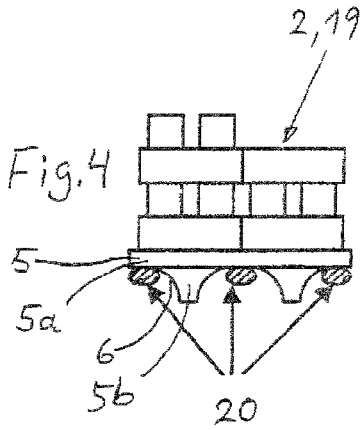
FIG. 4 shows the transfer device in a lateral view from the right.
Figure 3:
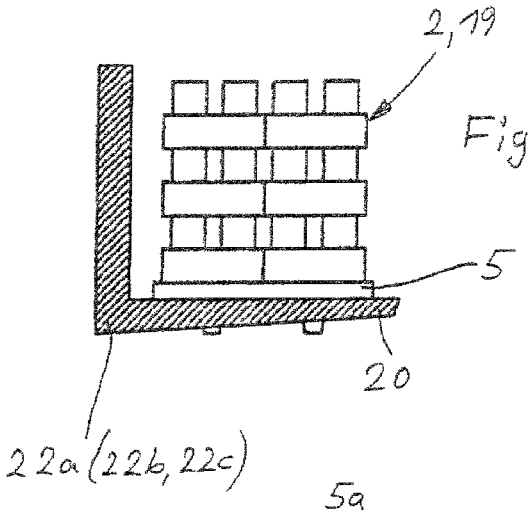
FIG. 3 shows a transfer device in a lateral view.
Figure 5:
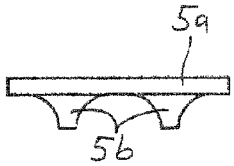
FIG. 5 shows a transport tray in a front view.
Figure 7:
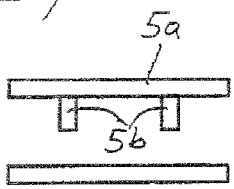
FIG. 7 shows a transport tray in a front view, in a modified embodiment.
Figure 6:
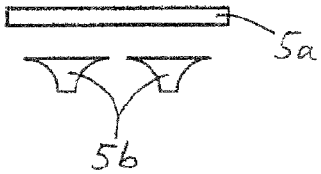
FIG. 6 shows the transport tray in a divided embodiment.
Figure 8:
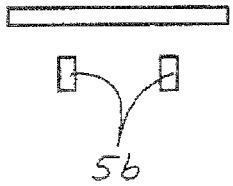
FIG. 8 shows the transport tray according to FIG. 7 in a divided embodiment.

FIGS. 3 and 4 show a transfer device 22*a*, 22*b*, 22*c*, which can be embodied in an identical manner and can be formed by a common transfer device 22*a*, as has already been described.

The transport trays 5 can be embodied in one part or several parts, for example, comprising a plate-shaped carrying element 5*a*, on the underside of which the feet 5*b* are arranged in a rigid manner. In one simple embodiment, the feet 5*b* can also be separate components which form fixed or loose parts of the transport tray 5. The cross-section of the feet 5*b* can be rectangular or tapering upwards, as is also shown in FIGS. 5 to 8.

Figure 9:
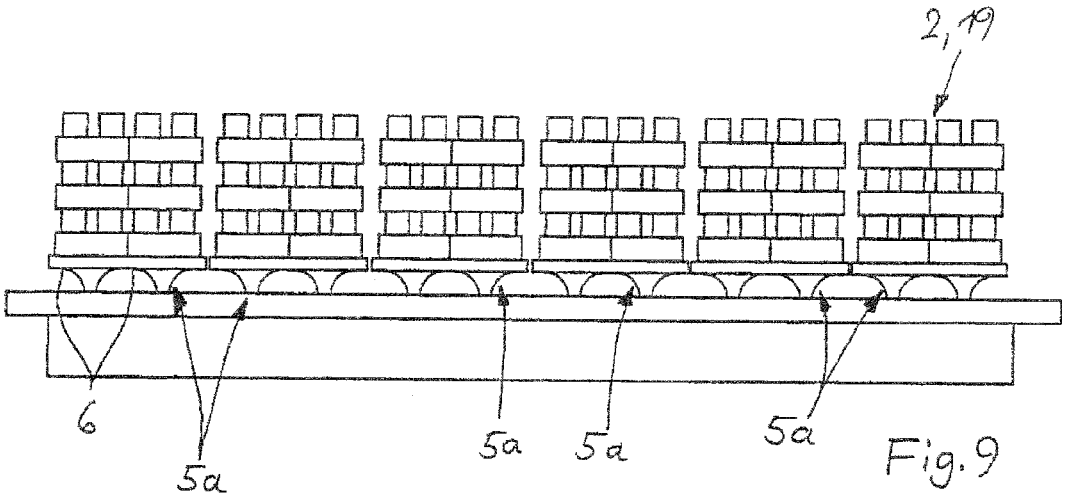
FIG. 9 shows several, for example, 6 transport trays arranged side-by-side and loaded with blanks, in an enlarged view.

FIG. 9 shows a batch 19 or stack with blanks on transport trays 5, which are positioned close to one another in a space-saving manner, so that the available space can be readily exploited.

One further substantial advantage of the device 1 according to the invention is that the transport trays 5 can be loaded or unloaded outside the kiln 4 or the associated supply set-down station 12 or dryer removal station 14. As a result, the at least one transfer device and/or a stack-removal device can be arranged in an operationally favourable and space-saving manner.

Figure 11:
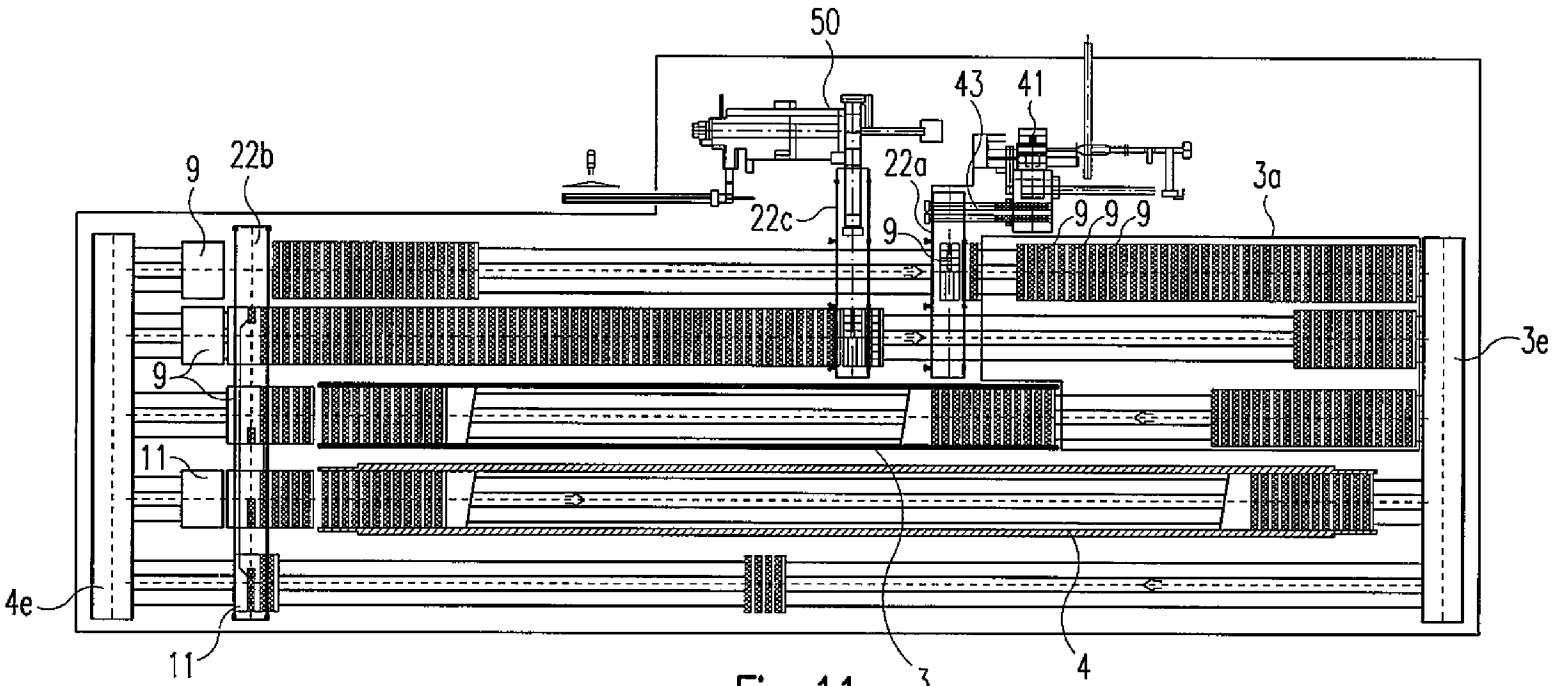
FIG. 11 shows a further alternative embodiment of a device according to the invention for transporting blanks.

FIG. 11 shows a further modified embodiment of a device for transporting blanks to and from a dryer and a kiln according to the present invention. In this context, identical and similar elements and devices are provided with identical and similar reference numbers, as in the embodiments described above and the previously presented drawings. The presentation in FIG. 11 corresponds to the presentation of the alternative embodiment from FIG. 10. All of the deliberations and explanations provided above also apply for the embodiment of FIG. 11, unless they are replaced by the following explanations.

With the embodiment illustrated in FIG. 11, as with the embodiments explained above, an implementation with two separate circulations for the dryer trolleys and the kiln trolleys is also proposed. Accordingly, it is possible to reduce the number of comparatively expensive kiln trolleys in the plant as a whole. In a similar manner to the case of the previous embodiments, with the embodiment from FIG. 11, an extrusion-moist slab is also produced by an extruder 41 from a blank-extrusion material, subdivided by an appropriate cutting device into moist blanks and supplied to a transfer device 22*a* by means of a conveyor 43. The transfer device 22*a* shown in FIG. 11 engages over the first two tracks and supplies the fresh blanks at the same time to dryer trolleys 9, which are disposed on the first two tracks. In this context, the fresh blanks in the sense of the present invention are not placed directly onto the dryer trolleys 9, but onto transport trays, which have already been explained in detail above. In one minor modification of the previously explained embodiments, the transport trays are already arranged on the trolleys 9 at the time of placing the fresh blanks by the transfer device 22*a*. The dryer trolleys 9, with the transport trays and the fresh blanks disposed on them, are transported away by the transfer device 22*a* on two tracks, that is, on the first two tracks illustrated (from above) in FIG. 11 towards the right, and transferred to a transfer platform 3*e*, which transfers the trolleys from the first and second track to the third track, on which the dryer trolleys 9 are transported in the direction towards the dryer 3, to the left in the view from FIG. 11. The two regions of the first tracks between the transfer device 22*a* and transfer platform 3*e* and the region between the transfer platform 3*e* and the dryer 3 on the third track is marked as the region 3*a*, which serves, so to speak, as a waiting region or supply region for the dryer 3. For example, there are application situations, in which the extruder 41 and the cutting device only operate on working days and are supervised by personnel during these working days, while the fresh blanks on the dryer trolleys 9 are passed through the dryer 3 for automatic drying during the weekend. In this context, it is important that, at the beginning of the weekend, sufficient fresh blanks, which can be dried over the weekend in the dryer 3, are already disposed on the dryer trolleys 9. For this purpose, the region 3*a* is used. The transfer platform 3*e* was also already presented, for example, in FIG. 10, and can move the trolleys from one track to the other in an automated manner. As an alternative, instead of a transfer platform, any other embodiment can be provided, which causes the trolleys to travel or to be moved from one track to the next track.

After the drying of the fresh blanks in the dryer 3, the dried blanks are transferred, together with the transport trays, by a transfer device 22*b* with the embodiment already described in detail above, to firing trolleys 11, which are disposed on the fourth track. The dried blanks, disposed together with the transport trays on the firing trolleys or kiln trolleys 11, are then driven or conveyed through the kiln 4. The transfer platform 3*e* then transfers the firing trolleys 11 with the fired blanks from the fourth track to the fifth track, where they are supplied to the transfer device 22*b*. The transfer device 22*b* transfers the transport trays with the fired blanks to drier trolleys 9 which are disposed on the first two tracks. The fired blanks are then supplied with the dryer trolleys, towards the right in the illustrated view, towards a further transfer device 22*c*, which is disposed in the direction of movement in front of the transfer device 22*a* already explained above. The transfer device 22*c* removes the fired blanks from the transport trays disposed on the dryer trolleys 9 and supplies them to an unloading plant 50, in which the fired blanks are further processed in a corresponding manner, for example, by packing and so on. The dryer trolleys 9 with the transport trays drive on from the transfer device 22*c* towards the transfer device 22*a*, where they are loaded with fresh blanks.

The transfer platform 4*e*, which, on the one hand, transfers dryer trolleys 9 after unloading by the transfer device 22*b* back from the third track onto the first and second track, and on the other hand, transfers unloaded firing trolleys 11 from the fifth track to the fourth track, where they are again supplied to the transfer device 22*b*, is clearly evident at the left-hand side of FIG. 11. The transfer device 22*b* always transfers the dried or respectively fired blanks together with the transport trays in the manner described above in greater detail.

As a result of the two separate circulations for dryer trolleys 9 and firing trolleys 11, it is possible to reduce the number of firing trolleys. Firing trolleys 11 are more expensive than dryer trolleys 9, so that a cost reduction can be achieved in this manner. With the embodiment shown in FIG. 11, it is possible to produce fresh blanks on working days, which are dried at the weekend in a semi-automatic or fully automatic manner in the dryer 3 and fired in the burner 4. Since a sufficient number of fresh blanks must already be provided before the beginning of the weekend, (waiting region 3*a*), the comparatively less expensive dryer trolleys 9, of which an sufficient number must be available, can be used for this purpose. The more expensive firing trolleys 11 must only be available in the required number for filling the kiln 4 plus shunting operations on the fourth and fifth track. The transfer device 22*b* and dryer 3 and kiln 4 can run in a fully automated manner on seven days, while the production and provision of fresh blanks in the extruder 41 and so on, and the unloading and further processing of the fired banks can be implemented with personnel supervision only on working days.

The invention claimed is:

1. A device for transporting blanks, wherein the blanks are made from an initially plastic, subsequently dried and finally fired material, the device comprising:

a transport tray configured to transport a stack of blanks through both a dryer and a kiln, wherein the transport tray is configured to transfer the blanks in each case with the transport tray such that the blanks need not be gripped and stressed;

at least one drying trolley;

at least one firing trolley;

a first transfer device configured to transfer the stack of blanks onto the at least one drying trolley, wherein the stack of blanks are stacked on the transport tray and are plastic;

the at least one drying trolley configured to transport the stack of blanks and the transport tray in the dryer;

the dryer configured to dry the stack of blanks which are plastic and are placed on the at least one drying trolley and the transport tray;

a second transfer device configured to transfer the stack of blanks and the transport tray from the at least one drying trolley onto the at least one firing trolley after the at least one drying trolley has passed through the dryer, wherein the stack of blanks have been dried;

the at least one firing trolley configured to transport the stack of blanks and the transport tray in the kiln;

the kiln configured to fire the stack of blanks placed on the at least one firing trolley and the transport tray; and a third transfer device configured to remove the stack of blanks from the at least one firing trolley without the transport tray after passing the at least one firing trolley through the kiln and configured to resupply the transport tray to the first transfer device, wherein the stack of blanks have been fired.

2. The device according to claim 1, further comprising a blank-loading device configured to stack the stack of blanks on the transport tray.

3. The device according to claim 1, further comprising a stack-removal device configured to remove the stack of blanks from the transport tray.

4. The device according to claim 1, wherein at least one of the first transfer device, the second transfer device and the third transfer device comprises a forklift.

5. The device according to claim 1, further comprising a first transfer platform configured to supply the at least one firing trolley to the second transfer device, wherein the stack of blanks are placed on the at least one firing trolley.

6. The device according to claim 5, further comprising a second transfer platform configured to supply at least one of the at least one of drying trolley and the at least one firing trolley to the third transfer device, wherein the stack of blanks are removed from the at least one of drying trolley and the at least one firing trolley.

7. The device according to claim 1, further comprising an unloading plant configured to pack the stacked of blanks, which have been fired and removed from the third transfer device.

8. A method for transporting blanks, wherein the blanks are made from an initially plastic, subsequently dried and finally fired material, the method comprising:

transferring a transport tray and a stack of blanks stacked on the transport tray onto a drying trolley by a first transfer device, wherein the blanks need not be gripped and stressed, and wherein the stack of blanks are not affected by a dryer or a kiln;

transferring the stack of blanks and the transport tray from the drying trolley onto a firing trolley by a second transfer device after the drying trolley has passed through the dryer, wherein the stack of blanks have been dried;

removing the stack of blanks with or without the transport tray by a third transfer device after the firing trolley has passed through the kiln, wherein the stack of blanks have been fired; and resupplying the transport tray to the first transfer device.

9. The method according to claim 8, wherein the stack of blanks are stacked on the transport tray by a blank-loading device, wherein the stack of blanks are not affected by the dryer or kiln.

10. The method according to claim 8, wherein the stack of blanks are removed from the transport tray by a stack-removal device.

11. The method according to claim 8, wherein at least one of the first transfer device, the second transfer device and the third transfer device comprises a forklift.

12. The method according to claim 8, wherein the firing trolley is supplied to a first transfer platform by a second transfer platform.

13. The method according to claim 12, wherein at least one of the drying trolley and the firing trolley is supplied to the third transfer device by the second transfer platform, wherein the stack of blanks are removed from the drying trolley and the firing trolley.

14. The method according to claim 8, wherein the stack of blanks, which have been removed by the third transfer device, are packed by an unloading plant.

* * * * *